United States Patent [19]

Hayashi et al.

[11] 4,451,041

[45] May 29, 1984

[54] GOLF CLUB HEAD AND A METHOD FOR MANUFACTURING THE SAME

[75] Inventors: Keijiro Hayashi, Takatsuki; Toshimi Awano, Ohogaki; Masayuki Yoshikawa; Kouzou Yazawa, both of Gifu; Takashi Ito, Ohogaki, all of Japan

[73] Assignee: Mizuno Corporation, Osaka, Japan

[21] Appl. No.: 463,891

[22] Filed: Feb. 4, 1983

[30] Foreign Application Priority Data

| | | | |
|---|---|---|---|
| Feb. 5, 1982 | [JP] | Japan | 57-18002 |
| Feb. 18, 1982 | [JP] | Japan | 57-25629 |
| Apr. 8, 1982 | [JP] | Japan | 57-59286 |

[51] Int. Cl.[3] ..... A63B 53/06

[52] U.S. Cl. ..... 273/167 H; 273/172; 273/DIG. 8; 264/257; 264/261

[58] Field of Search ..... 273/167 H, 169, 171, 273/172, 167 A, 167 F, 80.3, 80.2; 264/257, 261

[56] References Cited

U.S. PATENT DOCUMENTS

| | | | |
|---|---|---|---|
| 1,515,390 | 11/1924 | Hubbard | 273/169 X |
| 1,638,916 | 8/1927 | Butchart | 273/169 |
| 3,266,805 | 8/1966 | Bulla | 273/169 X |
| 3,692,306 | 9/1972 | Glover | 273/172 X |
| 3,843,122 | 10/1974 | Florian | 273/169 X |
| 4,076,254 | 2/1978 | Nygren | 273/171 X |

*Primary Examiner*—George J. Marlo

*Attorney, Agent, or Firm*—Fleit, Jacobson, Cohn & Price

[57] ABSTRACT

A golf club head comprises a shell of carbon fiber reinforced plastic, a polyulethane core embedded in the shell, a metal sole member having pointed pins extending through the shell into the core to position and retaining the core in the shell and an upwardly converging neck reinforcement embedded in the neck portion of the shell.

9 Claims, 10 Drawing Figures

GOLF CLUB HEAD AND A METHOD FOR MANUFACTURING THE SAME

The present invention relates to a golf club head made of carbon graphite fiber reinforced plastic.

In general, natural material such as Japanese persimmon has been used for golf club heads, particularly wood heads. However, the use of the natural material is disadvantageous in that lots of time and labor are required to shape a piece of persommon into a golf club head and that the yield rate is low. There has also been a difficulty in obtaining persimmon trees because of their shortage. Such being the situation, there has been known a head made of glass fiber reinforced plastic (hereinafter referred to as GFRP) which is produced by stiffening glass fiber with polyester resin, as described in Japanese Utility Model Publication No. 35-15505. In the head made of GFRP, however, the high specific gravity of glass fiber results in an increase in the head weight. In order to eliminate this disadvantage, a polyulethane core must have been embedded in GFRP of the head. The conventional method has disadvantages in that the core can not be properly retained in a mold so that the core may be displaced to an undesired position due to a pressure applied through GFRP to the core and the fluidity of GFRP during its molding to be exposed to the head surface upon completion of molding and this results in, a weaken portion of GFRP shell surrounding the core and having a non-uniform thickness throughout the head. An attempt has been made to reinforce the neck portion of the head by disposing glass fibers longitudinally and spirally therein but this process is most time-consuming, and besides, if the glass fibers of the longitudinal and spiral orientations were to have a failure in their rate, the neck portion of the head would not provide an enough strength to resist bending, compressive or tensile stress caused by impact on the head at the time of hitting the ball. That is, in case the rate of longitudinally disposed fibers relative to spirally disposed fibers is high, the neck portion has higher resistance against bending force but it is liable to be broken because of having lower resistance to torsional force. On the contrary, if the rate of spirally disposed fibers is higher than that of longitudinally disposed fibers, the neck portion has higher resistance against torsional force but lengthwise cracks are produced in the neck portion since it becomes weaker against bending force.

Japanese Utility Model Laid-Open Disclosure No. 50-9074 discloses a golf club head of carbon fiber reinforced plastic which has a lighterweight than the head made of GFRP because of the low specific gravity. Since the carbon fibers are large in diameter, the short fibers are not liable to be impregrenated and mixed with synthetic resin to become bulky cakes which may disturb the molding operation. A club head which is formed from such a mixture by means of a mold, is insufficient in its strength since the rate of the carbon fiber in the mixture is limited to about 30%. As particularly in the neck portion of the head, its sufficient strength is not expected unless the rate of fibers in the mixture exceeds 60%, the neck portion is liable to be broken by impact at the time of hitting the ball. Further, the carbon fiber reinforced plastic containing the carbon fibers of about 30% and synthetic resin of about 70% results in reduction in the wear-resistance of the sole portion of the golf club head so that the sole portion is easily worn.

On the other hand, the club head formed from only the carbon fiber reinforced plastic causes the deflection of the head and irregular ball flight directions since the inertia moment of the head during hitting of the ball is reduced due to an improper center of gravity and unbalance of the head weight.

A main object of the present invention is to provide a golf club head of carbon fiber reinforced plastic having the proper center of gravity and weight balance thereof and including the neck portion having its high strength, and a method of manufacturing the same.

Another object of the invention is to provide a golf club head in which a polyulethane core is properly positioned in CFRP shell of the head by securing the core to a metal sole member which covers the bottom of the shell to prevent the head from wearing off.

Further object of the invention is to provide a club head in which an upwardly converging reinforcement is embeded in the neck portion of the head to provide a high strength therefor.

These and other objects and advantages of the invention will become more apparent from the following description made with reference to the accompanying drawings in which.

Figure 1:
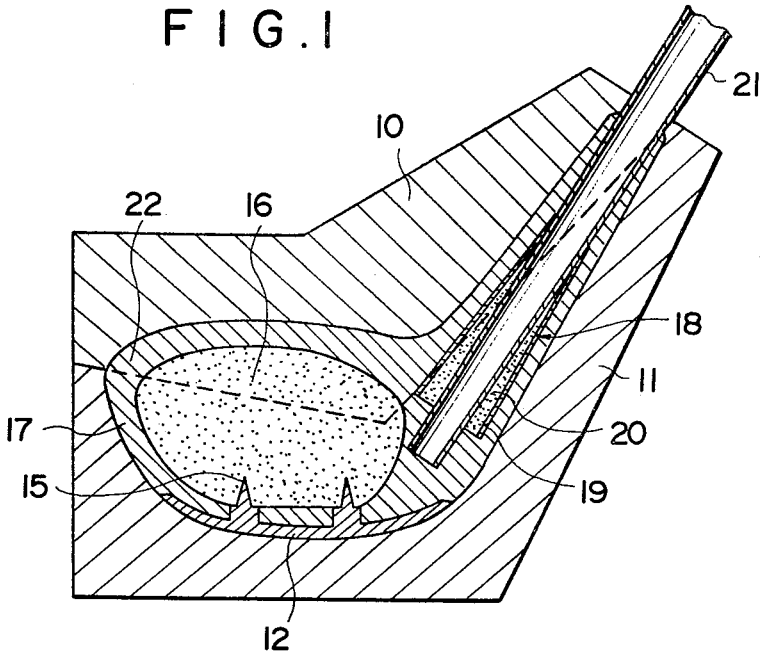
FIG. 1 is a cross-sectional view of a mold by which a golf club head according to the invention is formed.
Figure 2:
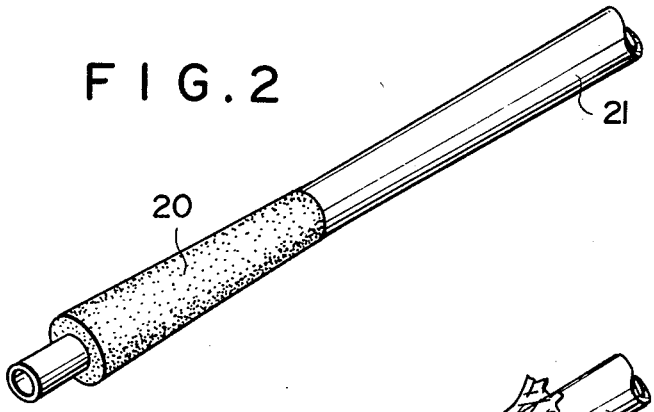
FIG. 2 is a perspective view of a mandrel having a tapered neck core fitted thereover.

Referring to FIG. 1 of the drawings, there is shown a mold including upper and lower mold halves 10, 11 defining a cavity in which a golf club head of the invention is formed. Positioned in the lower mold half 11 is a metal sole member 12 including a side portion 13 and a sole portion 14 formed integrally with each other. The sole portion 14 of the sole member 12 is provided with a plurality of pointed pins 15 extending upwardly of the inner surface thereof.

The lower mold half 11 is then filled with carbon fiber reinforced plastic comprising short carbon fibers impregnated with synthetic resin. A polyulethane core 16 is positioned and retained on the lower shell 17 of the carbon fiber reinforced plastic by penetrating the pointed pins 15 thereinto. Upwardly converging neck reinforcement 18 is disposed on the layer 17 in a position where the neck portion of the head is formed and comprises a fabric 19 of carbon fibers impregnated with synthetic resin and surrounded around an upwardly tapered neck core 20 into which a mandrel 21 is inserted. The carbon fiber reinforced plastic is deposited on the shell 17 to cover the core 16 and the neck reinforcement 18 and to form an upper shell 22 integral with the lower shell 17. The upper mold half 10 is then positioned on the lower mold half 11 to mold the golf club head and the mold is heated under pressure.

The golf club head thus produced comprises the shell of carbon fiber reinforced plastic having the polyulethane core 16 embeded therein and the metal sole member 12 including the integral side and sole portions 13 and 14. The use of the core 16 makes it possible to reduce the weight of the head because of the reduction in amount of the carbon fiber reinforced plastic having the carbon fibers of more than 60%. The center of gravity is lower in the head because of existance of the cores 16 and 20 and the metal sole member 12 to provide the excellent weight balance and the high inertia moment of the head and to prevent the head from deflecting during hitting of the ball, thereby improving the ball flight directions.

The core 16 is securely fixed in the center portion of the head by means of the pointed pins 15 penetrated thereinto. This prevents the core from displacing in the mold due to the molding pressure and fluidity of the carbon fiber reinforced plastic during molding operation. Thus, the shell of the head has a predetermined thickness and strength throughout the head.

Figure 3:
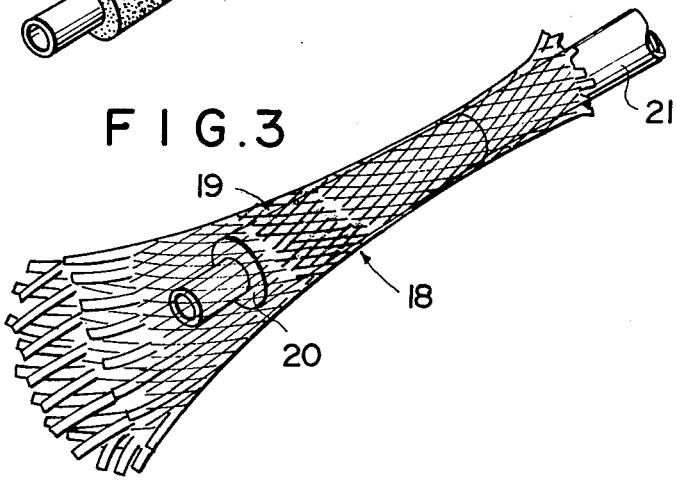
FIG. 3 is a perspective view of a fabric of carbon fibers surrounding the neck core.
Figure 5:
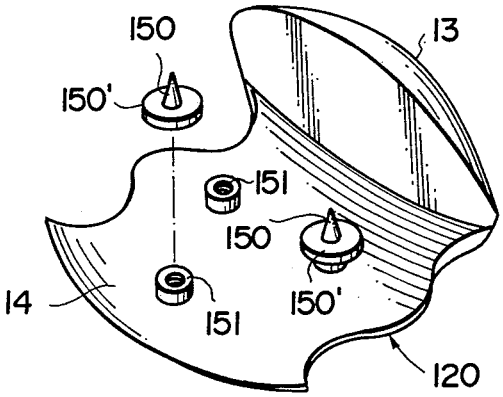
FIG. 5 is a view similar to FIG. 4 but showing flanged pointed pins threadedly secured to the sole member.
Figure 6:
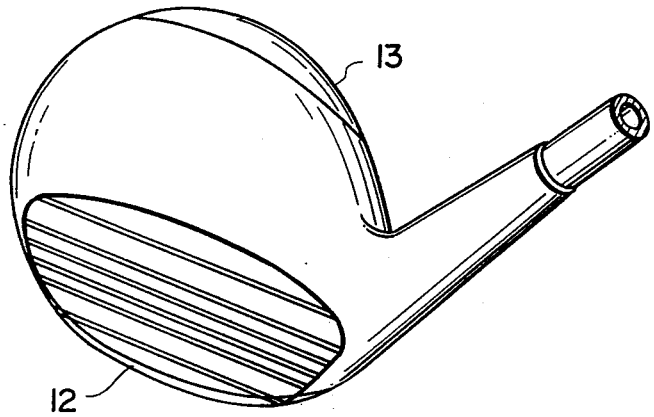
FIG. 6 is a perspective view of the golf club head formed in accordance with the invention.
Figure 9:
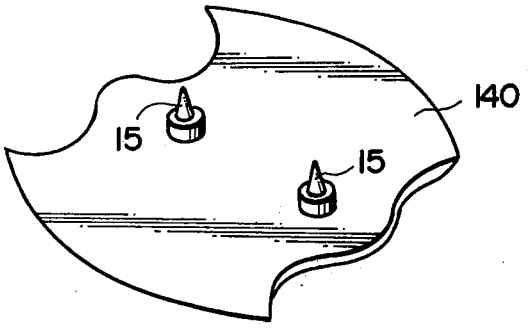
FIG. 9 is a perspective view of a modification of the sole member.
Figure 10:
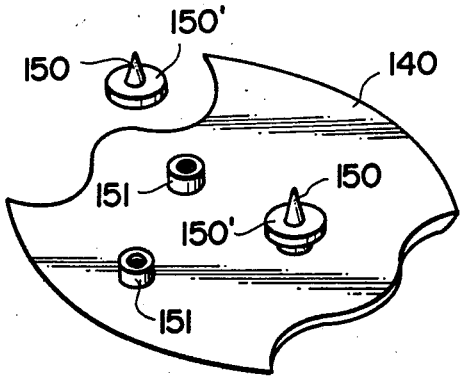
FIG. 10 is a view similar to FIG. 9 but showing another modification of the sole member.

In the head of the invention, the neck portion is provided with the upwardly converging neck reinforcement 18 comprising the fabric 19 of carbon fibers surrounding the upwardly tapered neck core 20. With this arrangement, the neck portion has the carbon fibers of more than 60% contained therein and thus has an enough uniform strength along the length thereof to resist the bending and torsional forces imposed thereon. As can be seen in FIG. 3, the fabric of carbon fibers is of the cylindrical shape and can be expanded along the tapered neck core to have different fiber densities along the neck portion. In FIG. 5 of the drawings, there is shown another embodiment of a metal sole member 120 having a plurality of flanged pointed pins 150 each threadedly secured to a projecting socket 151 on the inner surface of the sole member 120. With this arrangement, the sole member 120 is tightly connected to the lower shell 17 of the carbon fiber reinforced plastic by interposing it between the flanges 150' of the pins 150 and the sole member 120. The side portion of the metal sole member may be omitted as shown in FIGS. 9 and 10. The sole member serves to prevent the sole portion of the head from wearing off.

Figure 4:
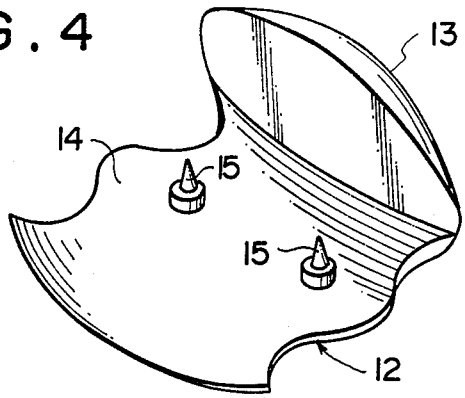
FIG. 4 is a perspective view of a sole member.
Figure 7:
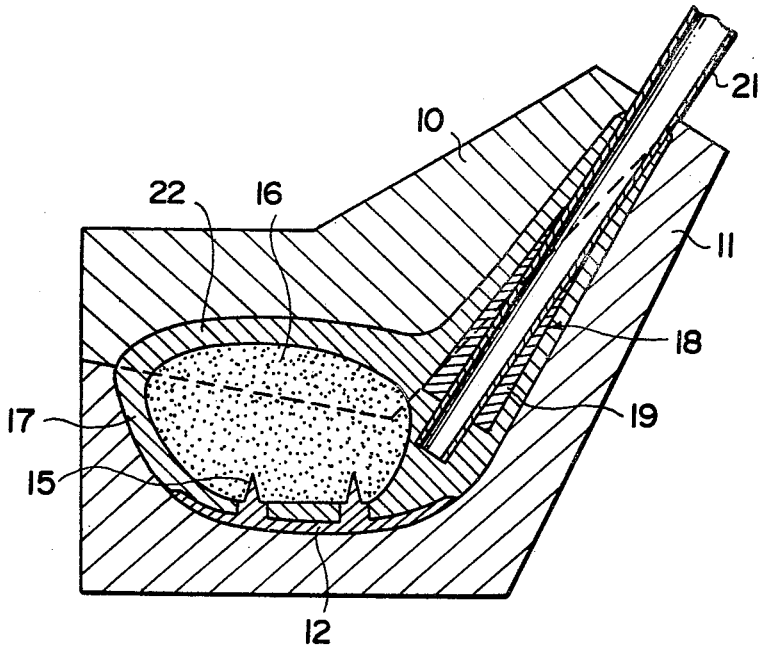
FIG. 7 is a view similar to FIG. 1 but showing the use of the upwardly converging reinforcement of only the fabric of carbon fibers.
Figure 8:
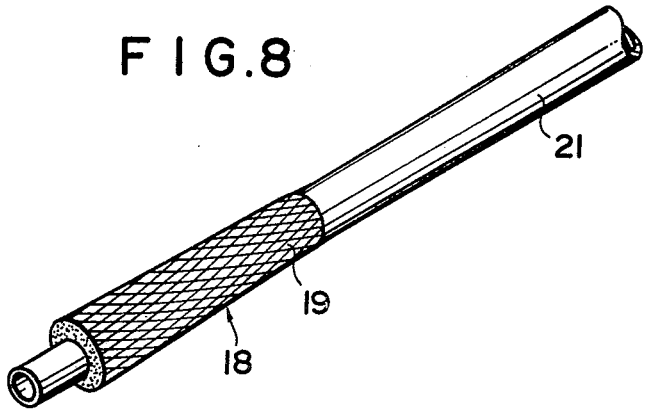
FIG. 8 is a perspective view of the mandrel having the reinforcement illustrated in FIG. 7 and fitted thereover.

An embodiment of the invention as shown in FIG. 7, is similar to that shown in FIG. 1 except that the upwardly converging reinforcement 18 comprises only a fabric 19 of carbon fibers impregnated with synthetic resin. In FIGS. 9 and 10, there are shown other metal sole members 140 with the side portion as shown in FIGS. 4 and 5 omitted. The pointed pins 15 which are similar to those illustrated in FIG. 4 in the embodiment of FIG. 9 are provided on the sole member 140 for positioning and retaining the core in the head shell. The embodiment of FIG. 10 is provided with the same flanged pointed pins 150 as in FIG. 5.

We claim:

1. A golf club head comprising a shell of carbon fiber reinforced plastic comprising carbon short fibers impregnated with synthetic resin, a core embedded in said shell to reduce the head weight, a metal sole member positioned on the bottom of said shell and having a plurality of pins extending from the inner surface thereof through said shell into said core to position and retain said core in said shell and an upwardly converging neck reinforcement embedded in the neck portion of said shell.

2. A golf club head as claimed in claim 1 wherein said metal sole member includes a sole portion and a side portion formed integrally with each other.

3. A golf club head as claimed in claim 1 wherein said metal sole member is in the form of a plate with the side portion omitted.

4. A golf club head as claimed in claim 1 wherein said pins are formed integrally with said sole member.

5. A golf club head as claimed in claim 4 wherein said pins comprise flanged pointed pins threadedly secured to sockets formed on the inner surface of said sole member.

6. A golf club head as claimed in claim 1 wherein said upwardly converging reinforcement comprises a fabric of carbon fibers impregnated with synthetic resin.

7. A golf club head as claimed in claim 6 wherein said reinforcement comprises an upwardly tapered core and a fabric of carbon fibers impregnated with synthetic and surrounding said core.

8. A golf club head as claimed in claim 1 wherein said core is of polyulethane.

9. A method for manufacturing a golf club head comprising steps of positioning a sole member in a lower mold half, said sole member being provided a plurality of pins projecting upwardly of the inner surface thereof, charging in said mold half carbon fiber reinforced plastic comprising carbon short fibers impregnated with synthetic resin to form a lower shell, positioning a polyulethane core on said lower shell by penetrating said pins thereinto, positioning on said lower shell adjacent the neck portion of the head an upwardly converging reinforcement fitted over a mandrel, depositing the carbon fiber reinforced plastic on said lower shell to cover said core and said reinforcement on said lower shell and to form an upper shell and positioning an upper mold half on said lower mold half to conduct the molding operation under pressure.

* * * * *